US009746297B2

(12) United States Patent
Buys

(10) Patent No.: US 9,746,297 B2
(45) Date of Patent: Aug. 29, 2017

(54) PROJECTILE

(71) Applicant: Andre Johann Buys, Pretoria (ZA)

(72) Inventor: Andre Johann Buys, Pretoria (ZA)

( * ) Notice: Subject to any disclaimer, the term of this patent is extended or adjusted under 35 U.S.C. 154(b) by 42 days.

(21) Appl. No.: 14/552,830

(22) Filed: Nov. 25, 2014

(65) Prior Publication Data

US 2015/0144018 A1 May 28, 2015

(30) Foreign Application Priority Data

Nov. 27, 2013 (ZA) ..... 2013/08914

(51) Int. Cl.

| | |
|---|---|
| ***F42B 12/40*** | (2006.01) |
| ***F42B 12/46*** | (2006.01) |
| ***F42B 10/06*** | (2006.01) |
| ***F42B 10/26*** | (2006.01) |
| ***F42B 14/06*** | (2006.01) |

(52) U.S. Cl.

CPC ..... *F42B 12/40* (2013.01); *F42B 10/06* (2013.01); *F42B 10/26* (2013.01); *F42B 12/46* (2013.01); *F42B 14/06* (2013.01)

(58) Field of Classification Search

CPC ..... F42B 12/36; F42B 12/40; F42B 12/46; F42B 10/04; F42B 10/16; F42B 10/26; F42B 10/38; F42B 10/06; F42B 14/00; F42B 14/06

USPC ..... 102/501, 502, 511, 512, 513; 244/3.23, 244/3.24, 3.3

See application file for complete search history.

(56) References Cited

U.S. PATENT DOCUMENTS

| | | | | |
|---|---|---|---|---|
| 2,338,719 A * | 1/1944 | Holt | ..... | F42B 12/40 102/395 |
| 2,441,388 A * | 5/1948 | Blackinton | ..... | F42B 12/10 102/476 |
| 2,494,026 A * | 1/1950 | Anderson | ..... | F42B 10/02 244/3.24 |
| 2,671,401 A * | 3/1954 | Abramson | ..... | F42B 10/06 102/373 |

(Continued)

FOREIGN PATENT DOCUMENTS

| | | | | |
|---|---|---|---|---|
| GB | 543950 A * | 3/1942 | ..... | F42B 10/06 |

OTHER PUBLICATIONS

Written Opinion of the International Searching Authority for PCT/IB2014/066235; Jun. 4, 2015.*

International Search Report for PCT/IB2014/066235; Jun. 4, 2015.*

*Primary Examiner* — James S Bergin

(74) *Attorney, Agent, or Firm* — Nath, Goldberg & Meyer; Joshua B. Goldberg; Christopher Thomas

(57) ABSTRACT

This invention relates to a non-lethal projectile to be fired using a paintball gun, and more particularly, but not exclusively, to an aerodynamic non-lethal projectile which is used for marking, inhibiting or administering medicinal or other chemical substances to live targets. According to a first aspect of the invention, there is provided a projectile comprising a body shaped to receive a capsule containing a substance, the body having a stabilizing member connected thereto for stabilizing the projectile in flight when the projectile is discharged from a weapon, and an annular member connected to the stabilising member at a rear end of the projectile for positioning the projectile relative to the weapon and relative to other projectiles to be discharged by the weapon.

7 Claims, 10 Drawing Sheets

(56) References Cited

U.S. PATENT DOCUMENTS

Figure 1:
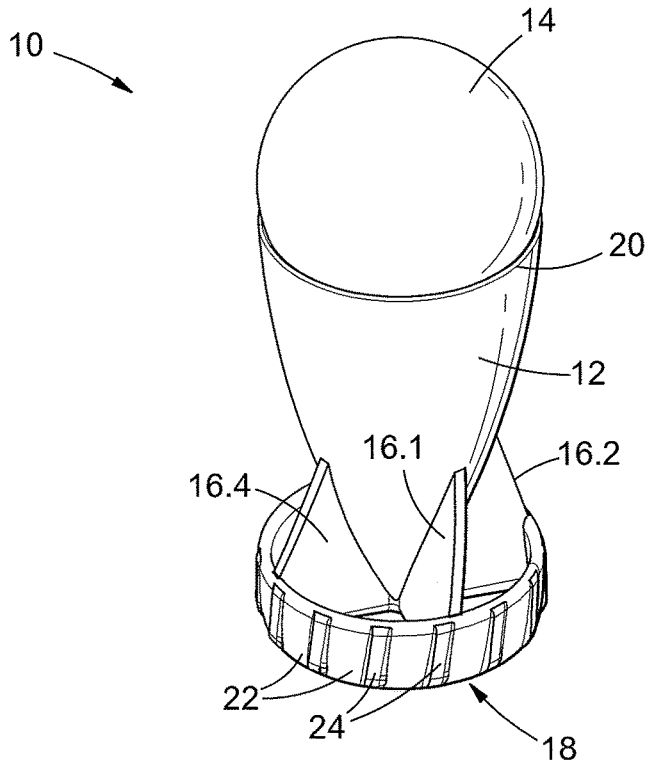

| | | | | | |
|---|---|---|---|---|---|
| 2,694,364 | A * | 11/1954 | Liljegren | F42B 30/10 | 102/373 |
| 3,532,300 | A * | 10/1970 | Voss | F42B 10/06 | 102/373 |
| 4,153,223 | A * | 5/1979 | Romer | F42B 10/48 | 102/503 |
| D348,907 | S * | 7/1994 | Prentice | D21/454 | |
| 7,262,394 | B2 * | 8/2007 | August | F42B 10/62 | 244/3.3 |
| 7,526,998 | B2 * | 5/2009 | Vasel | F42B 7/08 | 102/370 |
| 8,875,634 | B2 * | 11/2014 | Gibson | F42B 10/06 | 102/502 |
| 9,228,814 | B2 * | 1/2016 | Macy | F41A 9/65 | |
| 2006/0011090 | A1 * | 1/2006 | Vasel | F41B 11/62 | 102/512 |
| 2009/0013892 | A1 * | 1/2009 | Judson | F42B 10/26 | 102/502 |
| 2015/0144018 | A1 * | 5/2015 | Buys | F42B 14/06 | 102/502 |

* cited by examiner

PROJECTILE

FIELD OF THE INVENTION

This invention relates to a non-lethal projectile to be fired using a paintball gun, and more particularly, but not exclusively, to an aerodynamic non-lethal projectile which is used for marking, inhibiting or administering medicinal or other chemical substances to live targets.

BACKGROUND TO THE INVENTION

Non-lethal projectiles are frequently required for dispersal of crowds during riots in order to restore order, and to prevent damage to property, or even injury and loss of life in severe circumstances. Rubber bullets are most frequently used for such crowd control purposes. A disadvantage of said rubber bullets is resulting injuries caused to the human target, which include amongst others, contusions, lacerations and loss of eyesight. Fatal wounds caused by rubber bullets have also been reported.

An alternative to rubber bullets is projectiles that deliver inhibitory or marking substances. These projectiles are launched using a gun having a barrel for directing the projectile, a propulsion system which generally consists of a compressed gas (generally carbon dioxide) cylinder that releases a measured flow of gas via a valve or similar gas release mechanism when the gun is fired, and a container for containing multiple projectiles, the container or hopper being capable of delivering a single projectile into the barrel for each subsequent shot fired by the gun. The projectiles are commonly manufactured from elastic materials such as plastic or gelatine, and generally comprise an elastic outer shell containing an inhibitory substance such as teargas or pepper spray in crowd control applications, or a marking substance in mock war games (commonly known as paintball sport) or similar applications.

These projectiles are designed to rupture upon impact with the intended target, thereby spreading the inhibitory substance among the crowd and causing the crowd to disperse, or marking the target with the marking substance, as the case may be. Whilst an impact with such a projectile is still relatively painful, the incidence of physical or debilitating injury caused by these projectiles is relatively insignificant when compared to rubber bullets.

Projectiles may also be used in operations where a substance is applied to and absorbed through the skin of the target, typically an animal. In this way, for example, a solution of chemicals for control of various pests and/or diseases associated with animals can be contained in the projectiles and be effectively applied to the animal without the requirement of capturing, containing and physically applying the chemical solution to the animal. Projectiles may further be used in animal immobilisation operations where immobilisation substances such as opioids, cyclohexamines or neuroleptics is injected intramuscularly into the animal by projecting a syringe or dart towards the animal, with the immobilisation substance being delivered intramuscularly when the syringe or dart pierces the skin of the animal.

Projectiles delivering any of the aforementioned substances usually comprise two hemispheres joined together after being filled with a marking, inhibitory or chemical substance, as the case may be. The disadvantage experienced with conventional spherical projectiles is that a spherical shape is inherently aerodynamically unstable in flight. Spinning round projectiles are affected by the Magnus effect, whereby any spin of the projectile induces pressure differences around the projectile, creating a force perpendicular to the direction of travel. The Magnus effect adversely affects the accuracy of the intended point of impact. An additional disadvantage is that a spherical shape travelling through air at a high enough velocity will create turbulent flow increasing drag dramatically. In addition, the inner volume of the spheres, and the volume of the substance deposited into the projectiles also differ. These differences in volume cause a fluctuating weight and centre of mass between subsequent projectiles, which further compounds the inaccuracy disadvantage. Inaccuracy problems experienced with bullets and arrows have historically been overcome by giving the projectile a spin around the axis parallel to the direction of travel during flight. However, with substantially round projectiles one cannot easily and reliably give the projectile a spin that will remain parallel to the direction of intended travel.

In an attempt to at least partially overcome the inaccuracy disadvantage, a plurality of stabilising fins has been added to projectiles. The intended purpose of these stabilising fins is to make the projectiles more aerodynamic, by evenly distributing the propulsion forces to the projectile, and causing the projectiles to follow a straighter and more consistently replicable flight path. Available finned projectiles have a substantially spherical front end, with a finned rear end or tail, the rear end or tail consisting of two or more fins having varying lengths. A disadvantage experienced with known finned projectiles is that the shape of the finned projectiles, and in particular the shape of the rear end of the projectiles often lead to ineffective loading and storage. A further disadvantage of the finned projectiles is that the shape of the finned projectiles does not allow the projectiles to be fed into the barrel of the gun in the same way that the spherical projectiles can be fed into the barrel of the gun from the container provided for the projectiles. This leads to a single projectile either having to be loaded into the barrel manually before each shot, significantly reducing the effectiveness of the weapon, or having to be placed in a magazine similar to pistol or rifle cartridges in a pistol or rifle magazine. However, this leads to a further disadvantage, in that, due to the finned tails of the projectiles, it is not possible for a plurality of projectiles to be stacked onto one another in a magazine, and to be fed into the barrel following each shot with replicable effectiveness.

An even further disadvantage of the finned projectiles is that the fins are easily damaged or bent during packaging, transport or handling, which may cause the projectile to veer off course when it is fired, or to jam in the barrel or magazine of the gun.

A yet further disadvantage of known projectiles, whether finned or not, is the volume capacity of the projectile. A relatively small amount of substance can be accommodated in the sphere of the projectile and there is a requirement, in particular in animal treatment operations, to provide a projectile with a larger volume so as to deliver a larger amount of substance to the target. Simply providing a projectile with a larger volume, i.e. larger sphere, will require the provision of a gun having a larger barrel, meaning that a separate gun need to be acquired for specific purposes.

A yet further disadvantage is that only a single substance, whether a marking, inhibiting or chemical substance can be delivered to the intended target by a single projectile. In many instances, it is preferable or even required to provide different substances, such as different chemical solutions, to be directed at the intended target. In known operations, this will require the firing of separate projectiles (in many instances by separate guns) to the intended target.

A yet further disadvantage of the known projectiles is that substantially no spin can be imparted along the longitudinal axis of the projectile, as there are no means on the projectile to transfer spin from rifling, if any, within the barrel of the gun to the projectile. This at least partially affects the accuracy of the projectile.

OBJECT OF THE INVENTION

It is accordingly an object of the current invention to provide a projectile with which the abovementioned disadvantages could at least partially be alleviated or overcome.

SUMMARY OF THE INVENTION

According to a first aspect of the invention, there is provided a projectile comprising a body shaped to receive a capsule containing a substance, the body having a stabilising member connected thereto for stabilising the projectile in flight when the projectile is discharged from a weapon, and an annular member connected to the stabilising member at a rear end of the projectile for positioning the projectile relative to the weapon and relative to other projectiles to be discharged by the weapon.

The invention further provides for the capsule to be operatively rupturable.

Further according to the invention, the annular member may have substantially the same circumference as a front end of the body.

The invention further provides for the body to encapsulate a volume. The capsule may be shaped to at least partially fill the volume or the volume may be filled with the substance, with the capsule providing a cap over the body to enclose the substance, in the volume. Alternatively, the capsule and the body may contain different substances, with the capsule sealing the body similarly to the cap.

The capsule may be substantially conical, tear-shaped or spherical. The cap may be substantially conical or spherical.

Further according to the invention, the circumference of the body decreases towards the annular member and the stabilising member may be a plurality of fins helically arranged relative to the body to cause the projectile to operatively spin along its longitudinal axis. Preferably, the fins extend between a rear position, provided at around two thirds towards the rear end of the projectile, and the annular member. Alternatively, the fins may extend from a front end of the body to the annular member.

Further according to the invention, a plurality of equidistantly radially spaced apart fins may be provided.

The invention further provides for the annular member to include rifling lands and grooves.

The invention yet further provides for the projectile to further include a sabot releasably securable to the annular member.

Yet further to the invention there may be provided a connector for operatively connecting a second capsule with the capsule.

Yet even further according to the invention, the substance may be any substance selected from the group containing a solution of chemicals for control of various pests and/or diseases associated with animals, a marking substance for marking a target and an inhibiting substance for inhibiting a living target. The marking substance may be a mixture of water soluble substances such as polyethylene glycol and a suitable dye. The inhibiting substance may be a lachrymatory agent selected from the group consisting of mace, pepper spray (oleoresin capsicum), CS gas (2-chlorobenzalmalononitrile), CR gas (dibenzoxazepine), CN gas (phenacyl-chloride), nonivamide, bromoacetone, xylylbromide, and syn-propanethial-S-oxide, and similar chemistry. The solution of chemicals for pest and disease control may include any animal health product that is transdermally absorbed which may include any suitable pyrethroids, acaricides, such as Flumethrin, Fipronil, Deltamethrin, Ivermectin, and similar chemistry.

Still further according to the invention, the capsule may be provided with a mechanism for delivering an immobilisation substance within the capsule intramuscularly to a target animal, wherein, upon impact of the projectile with the target animal, the mechanism pierces the skin of the target animal, and the impact of the projectile with the target animal causes the immobilisation substance within the capsule to be expelled from the capsule and intramuscularly to the target animal. The immobilisation substance may be any substance selected from the group consisting of opioids, cyclohexamines, neuroleptics or similar chemistry. The mechanism may be a hypodermic needle provided with means for connection to the capsule and for accessing the contents of the capsule.

The projectile may be manufactured from a non-toxic, biodegradable, water-soluble polymer.

BRIEF DESCRIPTION OF THE ACCOMPANYING DIAGRAMS

Figure 2:
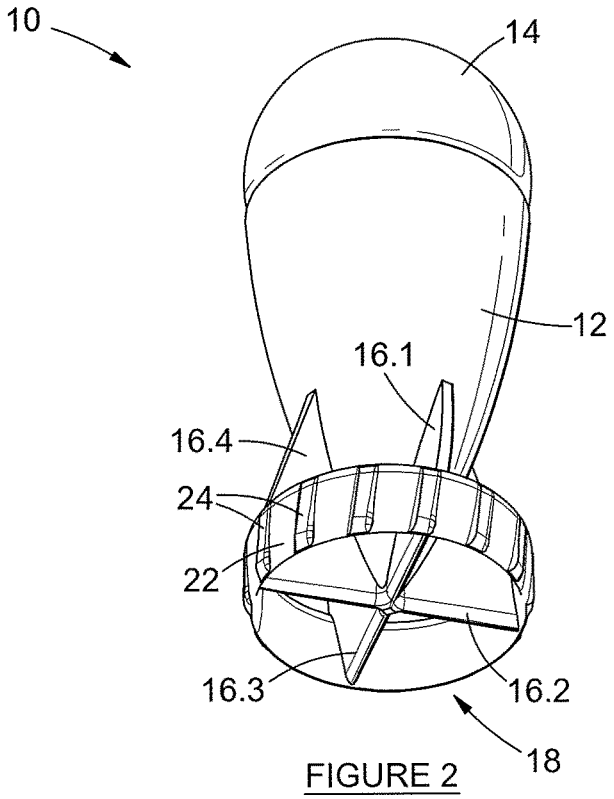
Figure 3:
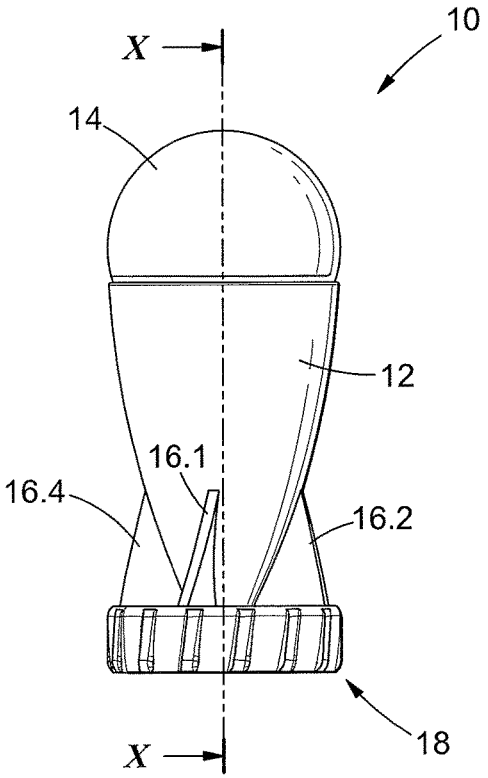
Figure 4:
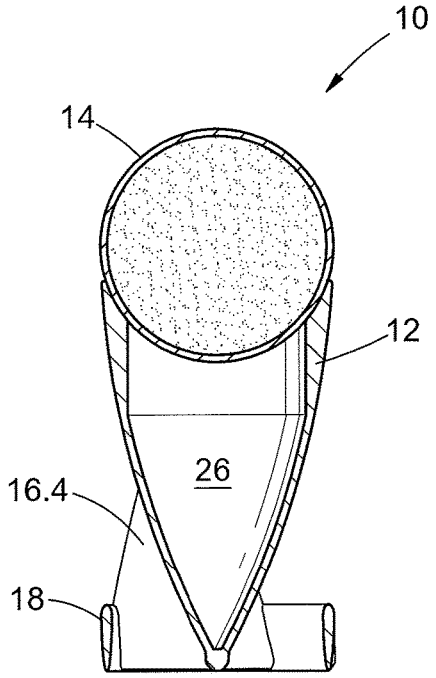
Figure 5:
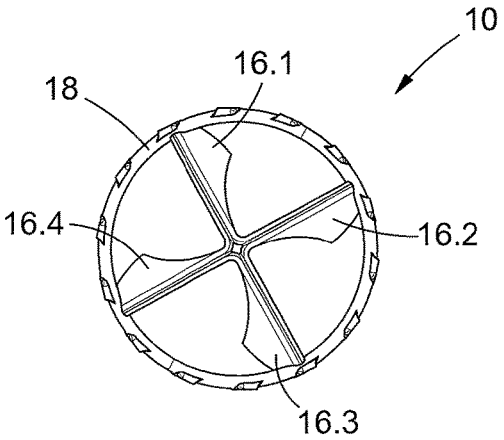
Figure 6:
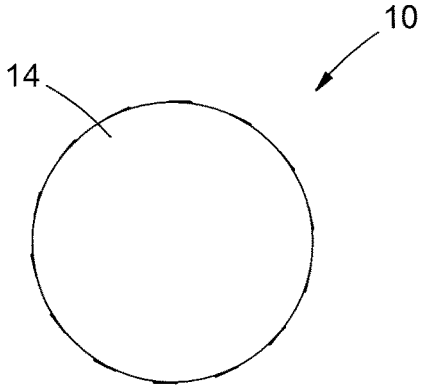
Figure 7:
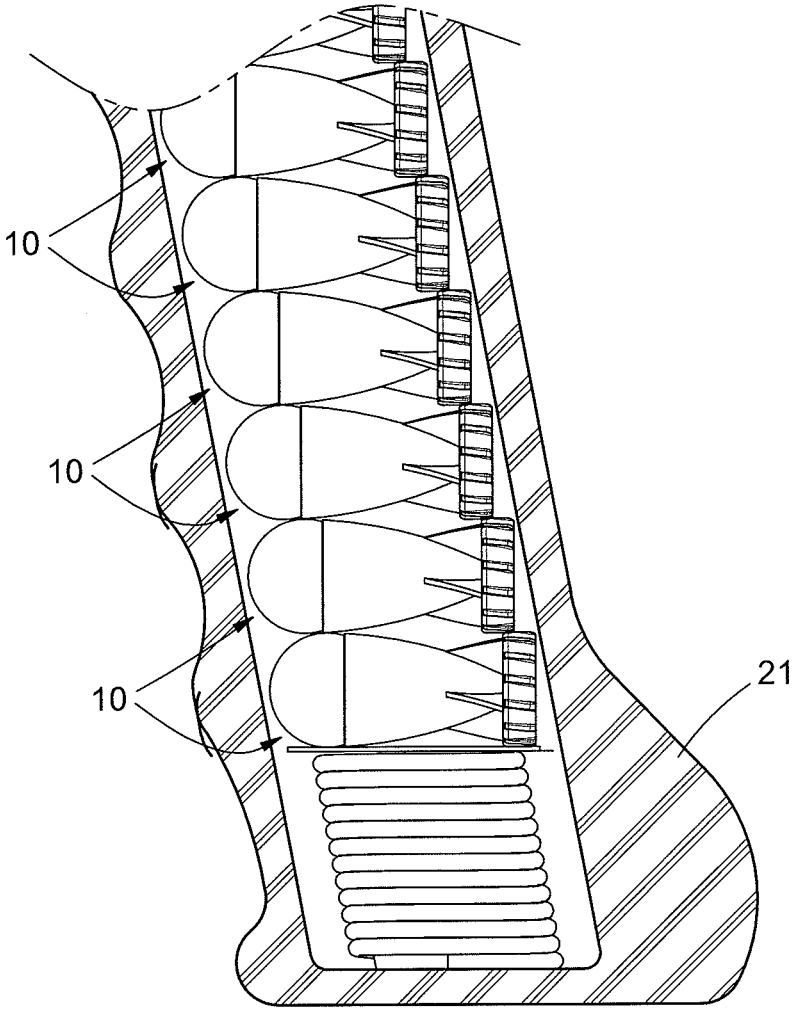
Figure 8:
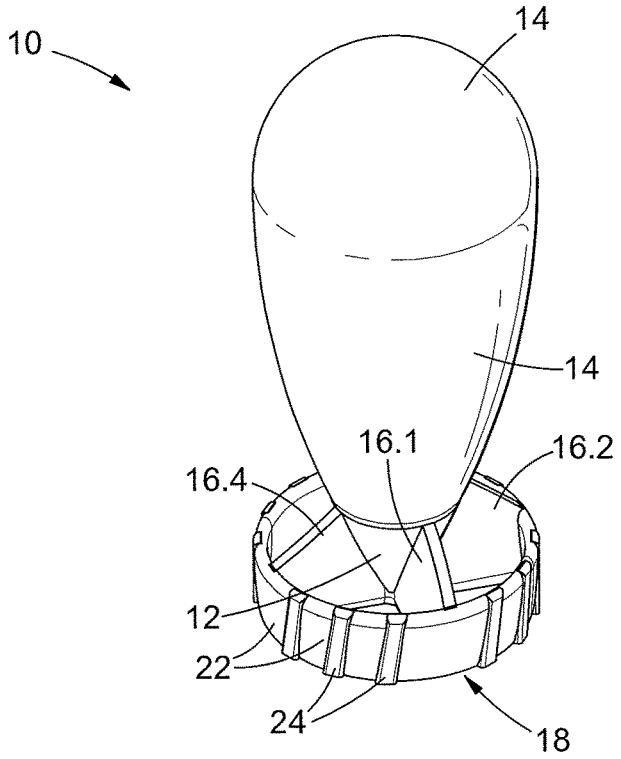
Figure 9:
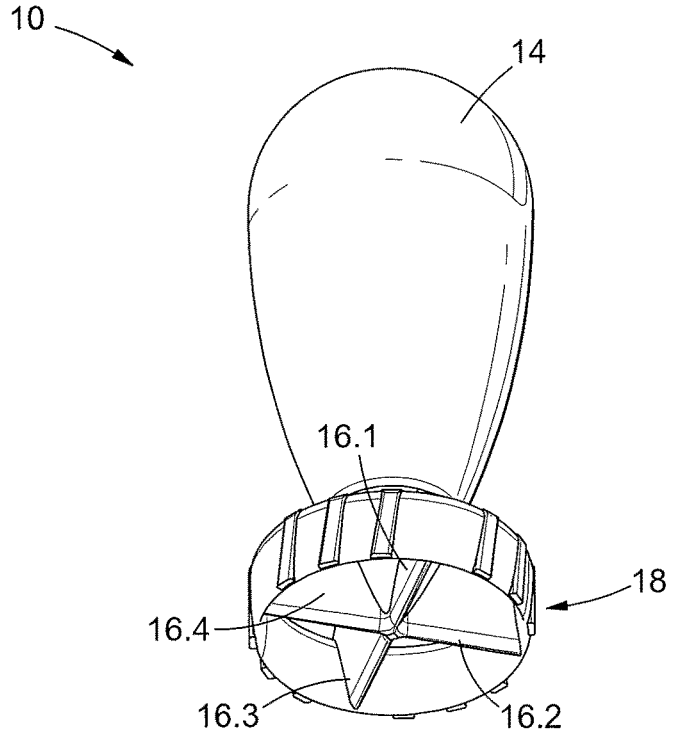
Figure 10:
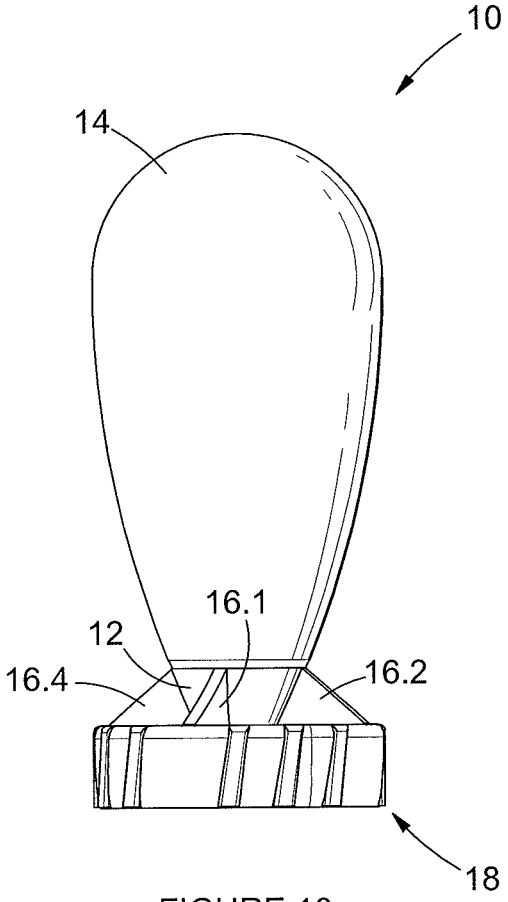
Figure 11:
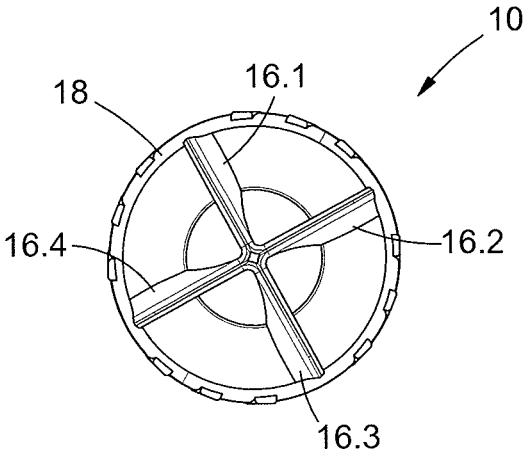
Figure 12:
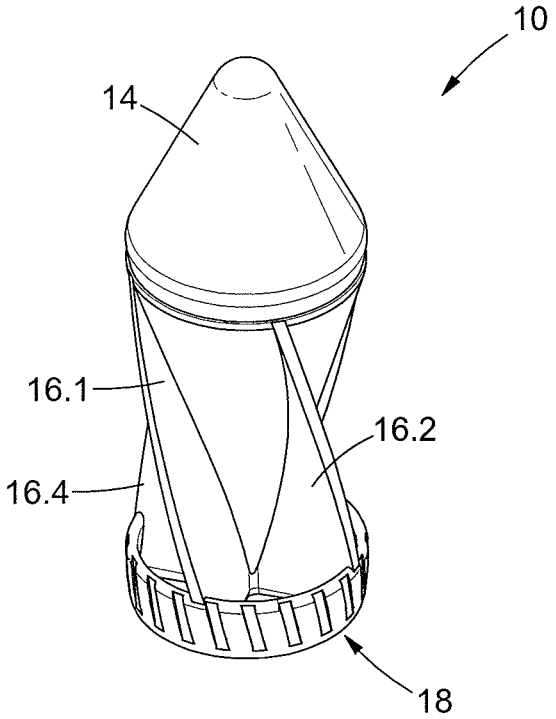
Figure 13:
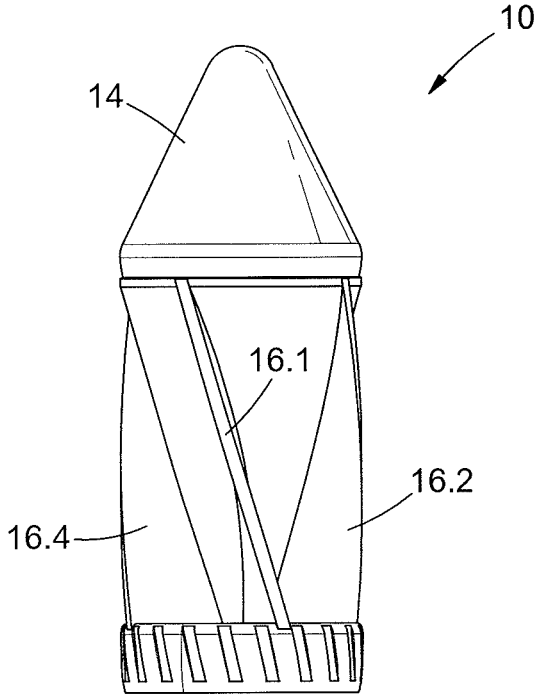
Figure 14:
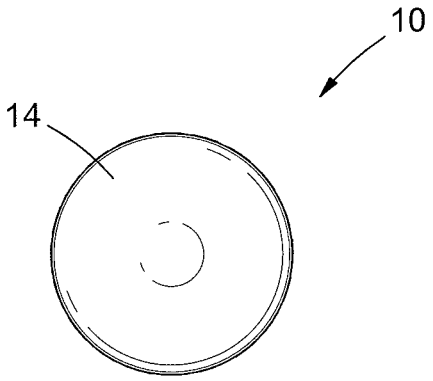
Figure 15:
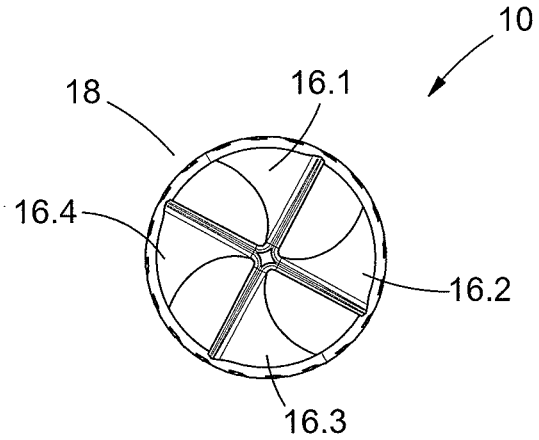
Figure 16:
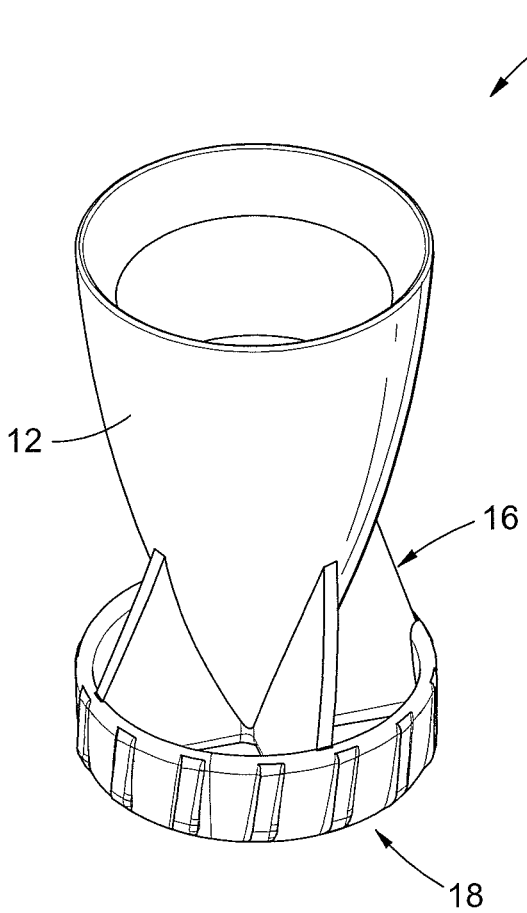
Figure 17:
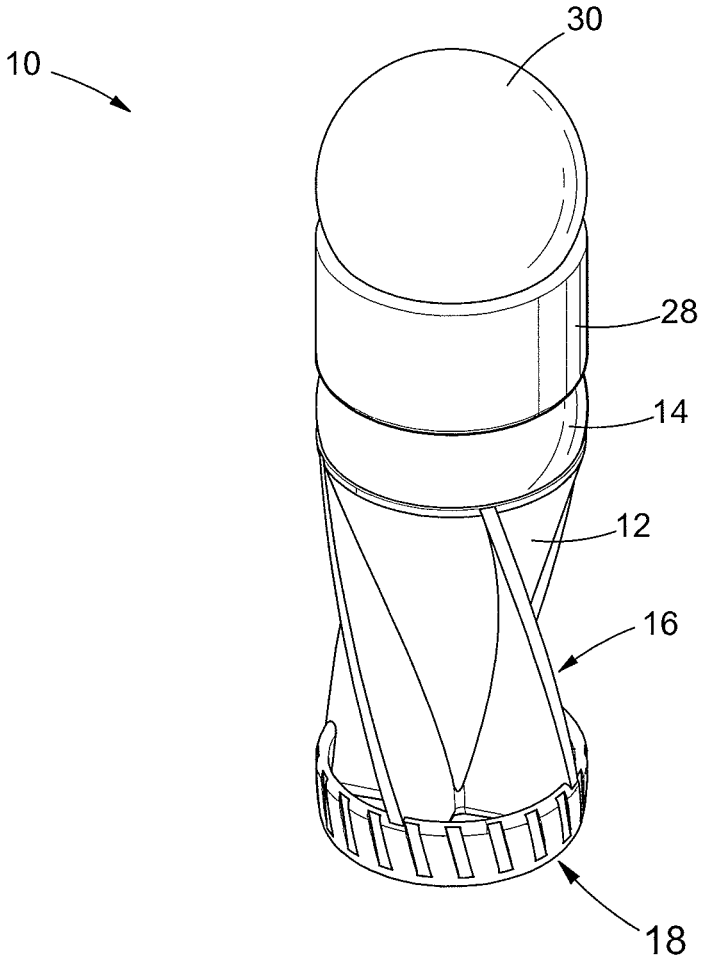
Figure 18:
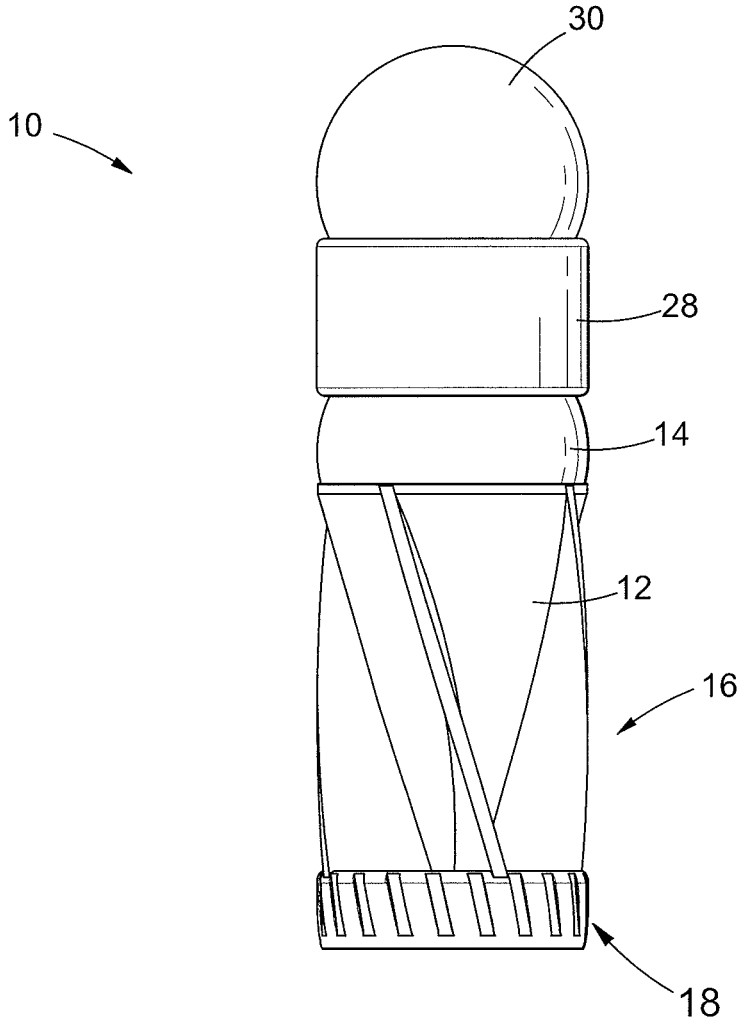
Figure 19:
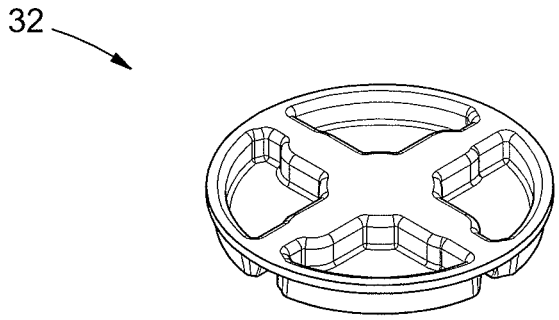
Figure 20:
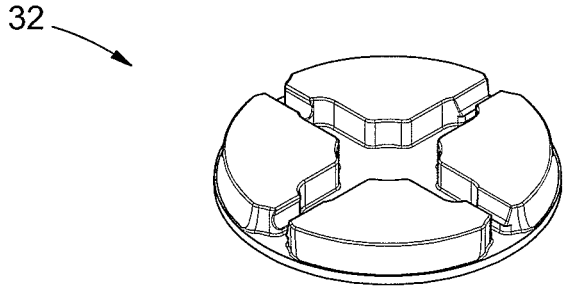

The invention is now described by way of example with reference to the accompanying drawings wherein:

FIG. 1: is a top perspective view of a projectile according to a first embodiment of the invention;

FIG. 2: is a bottom perspective view of the projectile of FIG. 1;

FIG. 3: is a side view of the projectile of FIG. 1;

FIG. 4: is a cross-sectional side view along line X-X of the projectile of FIG. 3;

FIG. 5: is a rear end view of the projectile of FIG. 1;

FIG. 6: is a front end view of the projectile of FIG. 1;

FIG. 7: is a side view of a magazine showing a plurality of the projectiles of FIG. 1 stacked upon one another;

FIG. 8: is a top perspective view of a projectile according to a second embodiment of the invention;

FIG. 9: is a bottom perspective view of the projectile of FIG. 8;

FIG. 10: is a side view of the projectile of FIG. 8;

FIG. 11: is a rear end view of the projectile of FIG. 8;

FIG. 12: is a top perspective view of a projectile according to a third embodiment of the invention;

FIG. 13: is a side view of the projectile of FIG. 12;

FIG. 14: is a front end view of the projectile of FIG. 12;

FIG. 15: is a rear end view of the projectile of FIG. 12;

FIG. 16: is a top perspective view of the body of the projectile of a fourth embodiment of the invention;

FIG. 17: is a top perspective view of the body of the projectile of FIG. 16 provided with a capsule, a connector and a second capsule;

FIG. 18: is a side view of the projectile of FIG. 16;

FIG. 19: is a rear perspective view of a sabot;

FIG. 20: is a front perspective view of the sabot of FIG. 18; and

Figure 21:
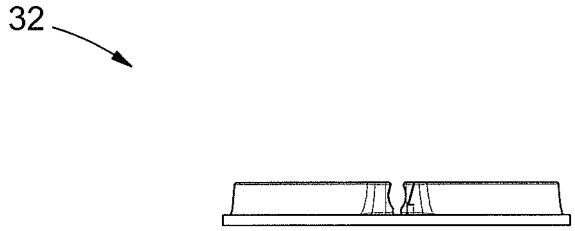

FIG. 21: is a side view of the sabot.

DESCRIPTION OF A PREFERRED EMBODIMENT OF THE INVENTION

Referring to the drawings, a projectile in accordance with the invention is generally indicated by reference numeral 10.

Projectile 10, to be fired using a paintball gun (not shown), includes a body 12 shaped to receive a capsule 14, a stabilising member 16 connected to the body 12 for stabilising the projectile 10 in flight, and an annular member 18 arranged on the stabilising member 16. In the embodiment shown in FIGS. 1 to 6 the capsule 14 (otherwise known as "paintballs") comprises two hemispheres (not shown) defining an inner volume filled with an inhibitory substance, a chemical substance or a marking substance (not shown), the composition of the substance being determined by the intended use of the projectile 10. The stabilising member 16 is in the form of a plurality of fins (16.1 to 16.4) in a helical arrangement relative to the body 12, which diameter decreases towards an operative back of the projectile 10 proximate to the annular member 18.

The purpose of the helically arranged fins 16.1 to 16.4 is to cause the projectile 10 to spin along the longitudinal axis of the projectile 10 in flight, thereby stabilizing the projectile in flight and counteracting any drift due to inconsistencies in symmetry of the projectile.

The substance in the capsule 14 is usually a marking substance for marking a target, or an inhibiting substance for inhibiting a living target, or a chemical solution for control of various pests and/or diseases associated with animals.

The marking substance is generally a water based paint, or other water soluble substances such as polyethylene glycol and a suitable dye.

The inhibiting substance is a lachrymatory agent such as mace, pepper spray (oleoresin capsicum), CS gas (2-chlorobenzalmalononitrile), CR gas (dibenzoxazepine), CN gas (phenacyl chloride), nomivamide, bromoacetone, xylylbromide, and syn-propanethial-S-oxide, and similar chemistry.

The solution of chemicals for control of various pests and/or diseases associated with animals (treatment operations) is any animal health product that is transdermally absorbed which may include any suitable pyrethroids and acaricides, such as Flumethrin, Fipronil, Deltamethrin, Ivermectin, and similar chemistry.

In a further alternative embodiment (not shown), the capsule is be provided with a hypodermic needle being connectable to the capsule causing access to an immobilisation substance within the capsule, for delivering an immobilisation substance intramuscularly to a target animal, wherein, upon impact of the projectile with the target animal, the hypodermic needle pierces the skin of the target animal, and the impact of the projectile with the target animal causes the immobilisation substance within the capsule to be expelled from the capsule and intramuscularly to the target animal via the hypodermic needle. The immobilisation substance is typically any opioid, cyclohexamine, neuroleptic or similar chemistry.

The projectile is manufactured from a non-toxic, biodegradable, water-soluble polymer.

In an alternative embodiment (not shown), the capsule of the projectile is solid, and not hollow, which gives it an application as a non-lethal impact projectile to be used when the marking or inhibiting substances are not achieving the required effect.

A front end 20 of the body 12 is shaped such that an existing paintball (containing whichever of the substances mentioned) can be retrofitted therein and used for purposes of marking, inhibiting, treatment or immobilisation as the case may be. If required, the capsule 14 may be glued with a suitable adhesive or otherwise secured to the body 12.

In the embodiment shown in FIGS. 1 to 6, the fins (16.1 to 16.4) extend from about two thirds (as measured from the front end 20) of the body 12 to the annular member 18. The annular member 18 furthermore has rifle grooves 22 and lands 24 which may interact with complimentary rifling in the barrel of the paintball gun and furthermore facilitates the spin of the projectile 10 in flight which improves the aerodynamic stability and accuracy of the projectile 10.

In an alternative embodiment shown in FIGS. 8 to 11, the capsule is tear-shaped. In this instance, the body 12 is relatively small compared to the capsule 14 to allow for a projectile with a relatively larger volume capacity for the substance. This embodiment is particularly suitable where the projectile is used in treatment or immobilisation operations. Furthermore, in this embodiment, the fins (16.1 to 16.4) extend from the front end 20 of the body 12 to the annular member 18.

In a yet alternative embodiment shown in FIGS. 12 to 15, the capsule 14 may be pointed towards an operative front end or substantially conical.

The annular member 18 has the advantage that it ensures that the fins 16.1 to 16.4 remain in a required position, and also protects the fins 16.1 to 16.4 during packaging, handling and storage. Furthermore, the annular member 18 has substantially the same diameter and circumference as the front end 20 of the body 12 and capsule 14, which enables multiple projectiles to be stacked onto one another in a magazine 21, as shown in FIG. 7, which ensures effective loading into the gun (not shown), storage of projectiles when not in use, and also aids in preventing the gun from jamming or misfiring. The annular member 18 also substantially increases the aerodynamic surface of the projectile 10, causing the projectile 10 to be fired more accurately, and to follow a more predictable and replicable flight path. The annular member 18 also moves the centre of pressure (CP) rearwards, increasing the stabilisation of the projectile without increasing the frontal area of the projectile. The projectile 10 is configured to fit in the barrel of the paintball gun and the diameter is configured to ensure optimum propulsion by the compressed air or other gas from the paintball gun.

It is also understood that the body 12 of any of the aforementioned embodiments is shaped to provide a volume which may be filled with any of the aforementioned substances. This volume can be seen in the cross-section shown in FIG. 4 and is illustrated as numeral 26.

Provision of a volume allows the capsule 14 that is shaped to fit and at least partially fill the volume of the body 12 but maintaining the exposed spherical or conical/pointed shape of the capsules 14 described above. Alternatively the capsule 14 may be provided as a spherical or a conical/pointed cap secured to the front end of body 12 to encapsulate a volume for and enclose the substance. These mentioned capsules effectively increase the volume of the substance delivered to the target. Alternatively, different substances may be provided in capsule 14 and volume 26. These different substances may be unrelated or complimentary.

As shown in FIGS. 17 and 18 a connector 28 may be provided to operatively connect a second capsule 30 to the projectile 10 to effectively increase the volume capacity of the substance. Alternatively the two capsules may be filled with two different substances which can be delivered to the intended target. In this embodiment it is understood that both capsules 14 and 30 will be ruptured upon impact with the target.

FIGS. 19 to 21 shows a sabot 32 which can be secured to an operative back end of the annular member 18. This further facilitates propulsion and effective velocity of the projectile 10 in that the volume of the barrel of the gun is operatively optimally utilised, which ultimately increases the range of the projectile. When the projectile 10 is fired from the paintball gun, the sabot 26 separates from the projectile 10 and the projectile 10 is propelled from the gun towards the intended target.

It will be understood that any combination of the above features may be provided without departing from the scope of the invention. For example, the shape of the capsule is not limited to a particular configuration of the fins, or the connector can be provided to connect any of the spherical capsules of the embodiments. The sabot will also be configured to fit on the back end of any of the projectiles described above. Furthermore, the number of lands and grooves on the annular member may be varied.

It is foreseen that the projectile according to the invention containing an inhibiting or marking substance could also be used in paintball guns for self defence purposes, and not only for crowd control or mock war game purposes.

It is further foreseen that the chemical solution of the substance can be used for treatment or immobilisation operations for animals.

It is accordingly asserted that the disadvantages associated with known projectiles for delivering marking inhibiting substances or chemical solutions could be alleviated with the projectile according to the invention.

In particular, the disadvantage of rubber bullets causing severe injury to human targets when used in riots is at least partially overcome, due to the projectile providing a less violent alternative and also enabling the shooter with a more accurate shot placement. The projectile causes less physical damage, and when an inhibiting substance is used, the effect of the projectile is also expanded to wider areas and more targets.

Furthermore, the disadvantage caused due to the prior art projectiles (paintballs) veering off course as a result of relatively significant turbulent airflow around the projectile in flight, caused by the Magnum effect or the assembly of two separate hemispheres forming a spherical projectile, and also the difference in volume of the substance located within the spherical front end between subsequent projectiles, is at least partially overcome by the projectile being made more aerodynamic due to the addition of the stabilising and positioning members, due to the helical fins of the stabilising member causing the projectile to spin in flight, making it more stable, and also due to the positioning member increasing the aerodynamic area of the projectile and moving the centre of pressure (CP) rearwards, increasing the stabilisation of the projectile without increasing the frontal area of the projectile.

The disadvantage of having to load finned projectiles individually, or not being able to place fins in a magazine is also overcome, due to the annular member that substantially matches the front end of the projectile in diameter and circumference which allows multiple projectiles to be stacked on each other. This allows the gun to be loaded more effectively following subsequent shots, and also for projectiles to be stored in a magazine for immediate use when required, such as in an emergency. The damage to fins of projectiles during handling, storage and packaging is also limited, due to the annular member protecting the fins.

The disadvantage of a relatively small volume of substance that may be delivered to the target is overcome by providing a larger volume as discussed above.

The disadvantage of providing a single substance to the target is also overcome by providing the connector which enables two or more separate capsules to be delivered to the intended target. It is also possible to further increase the volume, or even to provide more substances to be delivered to the intended target, by filling the volume encapsulated within the body of the projectile.

It will be appreciated that in terms of the invention, variations in details are possible without departing from the scope of the appended claims.

The invention claimed is:

1. A body for a non-lethal projectile, the projectile including a capsule containing a substance, the body being manufactured from a polymer and comprising a front end shaped to receive at least a part of the capsule containing the substance;

a stabilising member comprising a plurality of fins helically arranged relative to the body to cause the projectile to operatively spin along its longitudinal axis for stabilising the projectile in flight when the projectile is discharged from a gun; and an annular airfoil surrounding the fins at a rear end of the body for improving the aerodynamic stability and accuracy of the projectile in flight, and for positioning the projectile relative to the gun and relative to other projectiles to be discharged by the gun.

2. A body for a projectile as claimed in claim 1, wherein the annular airfoil has substantially the same outer diameter as the front end of the body.

3. A body for a projectile as claimed in claim 2, wherein the body defines a volume.

4. A body for a projectile as claimed in claim 3, wherein the volume at least partially receives the capsule.

5. A body for a projectile as claimed in claim 1, wherein the fins extend from a rear end of the body to a position no further than half way towards the front end of the body.

6. A body for a projectile as claimed in claim 1, wherein the polymer is a non-toxic, biodegradable, water-soluble polymer.

7. A non-lethal projectile comprising:

a body having an open front end, the body comprising:

a stabilizing member comprising a plurality of fins helically arranged relative to the body to cause the projectile to operatively spin along its longitudinal axis for stabilizing the projectile in flight when the projectile is discharged from a gun; and an annular airfoil surrounding the fins at a rear end of the body for improving the aerodynamic stability and accuracy of the projectile in flight, and for positioning the projectile relative to the gun and relative to other projectiles to be discharged by the gun; and a cap provided over the open end of the body, thereby forming an enclosed volume within the body for receiving a substance.

* * * * *